343-700 MS AU 251 EX
8/11/87 OR 4,686,535

United States Patent [19]

Lalezari

[11] Patent Number: 4,686,535

[45] Date of Patent: Aug. 11, 1987

[54] MICROSTRIP ANTENNA SYSTEM WITH FIXED BEAM STEERING FOR ROTATING PROJECTILE RADAR SYSTEM

[75] Inventor: Farzin Lalezari, Boulder, Colo.

[73] Assignee: Ball Corporation, Muncie, Ind.

[21] Appl. No.: 647,450

[22] Filed: Sep. 5, 1984

[51] Int. Cl.[4] ..... H01Q 1/38

[52] U.S. Cl. ..... 343/700 MS; 343/853

[58] Field of Search ..... 343/700 MS, 814, 815, 343/816, 853

[56] References Cited

U.S. PATENT DOCUMENTS

| | | | |
|---|---|---|---|
| Re. 29,296 | 7/1977 | Krutsinger et al. | 343/700 MS |
| Re. 29,911 | 2/1979 | Munson | 343/700 MS |
| 3,747,114 | 7/1973 | Shyhalla | 343/795 |
| 3,887,925 | 6/1975 | Ranghelli | 343/814 |
| 3,938,161 | 2/1976 | Sanford | 343/829 |
| 4,180,817 | 12/1979 | Sanford | 343/700 MS |
| 4,220,956 | 9/1980 | Sanford | 343/706 |
| 4,233,607 | 11/1980 | Sanford | 343/700 MS |
| 4,356,492 | 10/1982 | Kaloi | 343/700 MS |

*Primary Examiner*—Eli Lieberman
*Attorney, Agent, or Firm*—Gilbert E. Alberding

[57] ABSTRACT

A microstrip antenna system has a central two-dimensional array (preferably square having at least 16×16 elements) of integrally formed conductive dual slot microstrip radiator patches. A corporate-structured array of interconnected microstrip feedlines connects a common input/output r.f. signal feedpoint to each of the central array patches and also incorporates a fixed-angle phasing offset so as to steer the main lobe or beam of the overall radiation pattern off-center. The common r.f. signal input/output connection point is itself physically offset to one side of the overall composite of array elements. Auxiliary tapered amplitude linear arrays of dual slot patches also preferably extend on all sides outwardly from the periphery of the central array so as to reduce the side lobe amplitude and main lobe beamwidth of the overall radiation pattern. Both series-fed and series-tapped tapered amplitude feedlines are used depending upon whether the auxiliary linear array extends in the E-plane direction or the H-plane direction. The fixed phasing offset is preferably in the H-plane direction of the overall central array. Pairs of broadbanding microstrip stubs may be disposed along the corporate structure feedline in association with predetermined subsets of dual slot patches within the central array so as to increase the frequency bandwidth over which impedance matched signal feeding is achieved.

35 Claims, 6 Drawing Figures

MICROSTRIP ANTENNA SYSTEM WITH FIXED BEAM STEERING FOR ROTATING PROJECTILE RADAR SYSTEM

This invention generally involves microstrip antennas and, in particular, a unique and highly advantageous form of microstrip antenna system with fixed beam steering for use in the radar system of a rotating "smart" projectile.

Very thin conformal microstrip antenna systems of many types are by now well known in the prior art. For example, so called dual slot microstrip antenna elements are described in commonly assigned U.S. Pat. No. Re. 29,296—Krutsinger et al wherein photo-chemical etching techniques (similar to those used in the fabrication of printed circuit boards) are used to realize an integrally formed layer of conductive radiator "patches" and microstrip feedlines supported above a more extensive reference surface by a thin dielectric layer. The dielectric layer is typically on the order of one-tenth wavelength or less in thickness at the intended operating frequency of the antenna. The dual slot radiator "patch" structure is one-half wavelength (in the dielectric) in a resonant E-plane dimension so as to form radiating slots between the transverse H-plane edges of the "patch" and the underlying ground plane. In this way, a single radiator patch defines a pair of radiating slots and thus the name "dual slot" microstrip antenna.

A subsequent commonly assigned patent (U.S. Pat. No. Re. 29,911—Munson) further explains such microstrip radiator patches including the use of dual slot patches in two dimensional arrays and corporate-structured microstrip feedlines for interconnecting such an array of radiator patches. This same prior art patent also describes (e.g. at FIG. 10) techniques for achieving an amplitude-tapered aperture for such an array so as to reduce side lobes in the overall radiation pattern of the array. Although the common input/output feedpoints for the two-dimensional array shown in U.S. Pat. No. Re. 29,911—Munson are all located centrally or internally of the two-dimensional array structure, the common input/output points for linear arrays shown in U.S. Pat. No. Re. 29,911 are, of course, offset to one side with respect to the linear array due to the very usage of corporate-structured feedlines for such a linear array.

The use of series-fed dual slot microstrip radiator patches is also revealed in commonly assigned prior art U.S. Pat. No. 4,180,817—Sanford and U.S. Pat. No. 4,220,956—Sanford. In part, such series feeding is there recognized as useful in achieving a form of amplitude taper across the aperture of an array. Furthermore, U.S. Pat. No. 4,180,817—Sanford also teaches two-dimensional arrays of dual slot microstrip radiator patches which include a common input/output feedpoint offset from the two-dimensional array.

Commonly assigned prior-issued U.S. Pat. No. 4,233,607—Sanford et al also employs compensation "stubs" or the like located along a microstrip feedline for, in that case, improving r.f. isolation between substantially adjacent transmitting/receiving dual slot microstrip antenna installations.

Commonly assigned prior-issued U.S. Pat. No. 3,938,161—Sanford is also of interest in showing a two-dimensional array having an offset common input/output feedpoint in conjunction with opposingly directed corporate-structured feedlines for feeding interleaved halves of an overall array.

As those in the art will appreciate, since the initial discovery of thin conformal microstrip antenna structure, their use has proliferated and become commonplace in recent years for many different types of applications. The above referenced prior-issued U.S. patents are merely exemplary of a large number of prior art microstrip antenna structures of many different types.

For some types of "smart" projectiles, a radar or other sensing antenna system must be located at or near the leading edge or surface of the projectile. Yet, at the same time, it must not unduly interfere with the primary objective of the projectile. For example, in some applications, the projectile may include a shaped charge located just behind the leading surface and any substantial structural impediment placed in front of such a shaped charge may cause it to "defocus" and thus have less than the desired effect upon detonation.

Although it is readily apparent that some form of thin microstrip antenna might be an ideal type of radar antenna for placement along the leading surface of such a shaped charge projectile, there remains a substantial question as to exactly what type of microstrip antenna system can be devised so as to simultaneously meet many different design criteria. For example, the antenna for this application should operate in the Ka band (e.g. 26.5 to 40.0 gigahertz) and be on the order of only about 0.005 inch thick if it is not to unduly "defocus" a shaped charged located directly therebehind. Linear (e.g. "vertical") polarization is desired for the antenna operation. The main lobe beamwidth must be extremely small and must have considerable gain while the side lobes of the overall radiation pattern are to be minimized and the operative frequency bandwidth should be as wide as possible. For this particular application, the axis of the principle beam lobe should be precisely steered off-center by a predetermined fixed amount (i.e. away from a centered normal line along the spin axis of the projectile) so that the radar sensor will be caused to scan an underlying ground target area while it spins on its descent to the ground. Since each relatively small projectile must have its own antenna and since the antenna is destroyed upon detonation of the projectile (e.g. the shaped charged actually projects itself through the antenna structure upon detonation), low cost fabrication techniques are desired. At the same time, permitted manufacturing tolerances must be considered where large numbers of such systems are to be supplied at relatively low cost with a high probability that each device will nevertheless fulfill all of the rather strict antenna design criteria.

My own initial attempts to design an appropriate microstrip antenna for this particular application typically utilized only series fed dual slot microstrip radiator patches. After considerable unsuccessful trial and error design attempts using such series-connected arrays, I have finally concluded that it is not possible to simultaneously meet all of the desired design criteria using this approach.

However, I have now discovered a microstrip antenna system having a novel combination of features with which it is possible to simultaneously achieve all of the desired design criteria for a rotating projectile radar system of the type just described.

In brief summary, dual slot microstrip radiator patches are used so as to facilitate the desired linear polarization and low cost fabrication (e.g. no requirement for plated through holes or the like). A rather large central two-dimensional array of dual slot radiator patches is utilized so as to achieve the desired small beamwidth and this central array is fed from a common input/output point by a corporate-structure microstrip feedline (all intergrally formed with the patches) so as to facilitate the desired relatively wide bandwidth of operation while at the same time minimizing undesired beam steering deviations with respect to frequency. The common r.f. signal input/output connection point is offset to one side of the central array so as to accomodate a similarly offset coaxial or other conventional feedline structure from the electronics components so as to substantially avoid interference with the shaped explosive charge disposed directly behind the antenna structure. A fixed-angle phasing offset is also incorporated directly within the corporate-structured feedline network so as to steer the main beam of the overall radiation pattern off-center by the desired amount. The central two-dimensional array is preferably of substantially square-shape having a size of at least 16×16 dual slot radiator patches. Although smaller sizes (e.g. 8×8 radiator patches) and/or non-square shapes (e.g. 14×16 or otherwise as might be achieved by simply truncating a 16×16 array in various fashions about its edges) might possibly be usable under some circumstances, such smaller and/or non-square arrays are believed to introduce substantial degradation in the desired performance.

Where vertical polarization along the resonant E-plane direction of the dual slot radiators is utilized, the fixed angle phasing offset is preferably effected along the transverse H-plane dimension of the central array so as to provide an appropriate "lead time" in the operation of the rotating projectile radar system.

The use of a relatively large square array (e.g. 16×16 or larger) also tends to maximize the overall gain of the antenna aperture while minimizing its main lobe beam width. So as to attenuate the unwanted side lobes of the overall radiation pattern while yet further minimizing main lobe beamwidth, auxiliary linear arrays of dual slot patches are provided in all directions extending outwardly from the periphery of the central array. These auxiliary linear arrays include auxiliary tapered amplitude microstrip feedline structures (of either the series fed or series-tapped variety) connected to the outer portions of the central corporate-structured feedline array. The auxiliary radiating patches within each auxiliary array are thus fed with "tapered" or successively reduced r.f. signal amplitudes as the distance from the central array increases so as to reduce the side lobe amplitude as well as the main lobe beamwidth evey further than otherwise would be possible. Microstrip feedlines are series connected between opposing edges of successive auxiliary linear array patches which extend in the E-plane direction of the central array. A modified corporate-structured single microstrip feedline having a series of successive series-taps therealong is used for the auxiliary linear arrays extending along the transverse H-plane direction of the central array. The auxiliary linear arrays of the first type typically extend on opposite sides of the central array while auxiliary linear arrays of the second type extend on the two other opposite sides of the central array. Preferably, the number of patches in each auxiliary linear array decrease as one progresses toward the edges of the central array so as to provide an overall approximately circularly-shaped composite antenna system so as to optimally fit within the circular leading surface cross section of a typical projectile. Where the auxiliary arrays are utilized, the offset input/output connection point is preferably sufficiently offset to be located to one side of the overall composite antenna system (i.e., including such auxiliary linear arrays).

A further refinement may be provided to insure sufficiently broad-banded impedance matching within the feed structure. For example, pairs of broad-banding microstrip stubs may be disposed along the central corporate-structure feedline in association with predetermined subsets of patches within the central array. Such pairs of broad banding stubs are in and of themselves known in the prior art and may be associated with different numbers of radiator patches (e.g. 1, 2, 4, 8, etc.); however, in the preferred exemplary embodiment, if such broad banding stubs are utilized, they are preferably utilized in conjunction with subsets of four individual dual slot radiator patches.

These as well as other objects and advantages of the invention will be better appreciated and understood upon reading the following detailed description of the presently preferred exemplary embodiment taken in conjunction with the accompanying drawings, of which:

Figure 3:
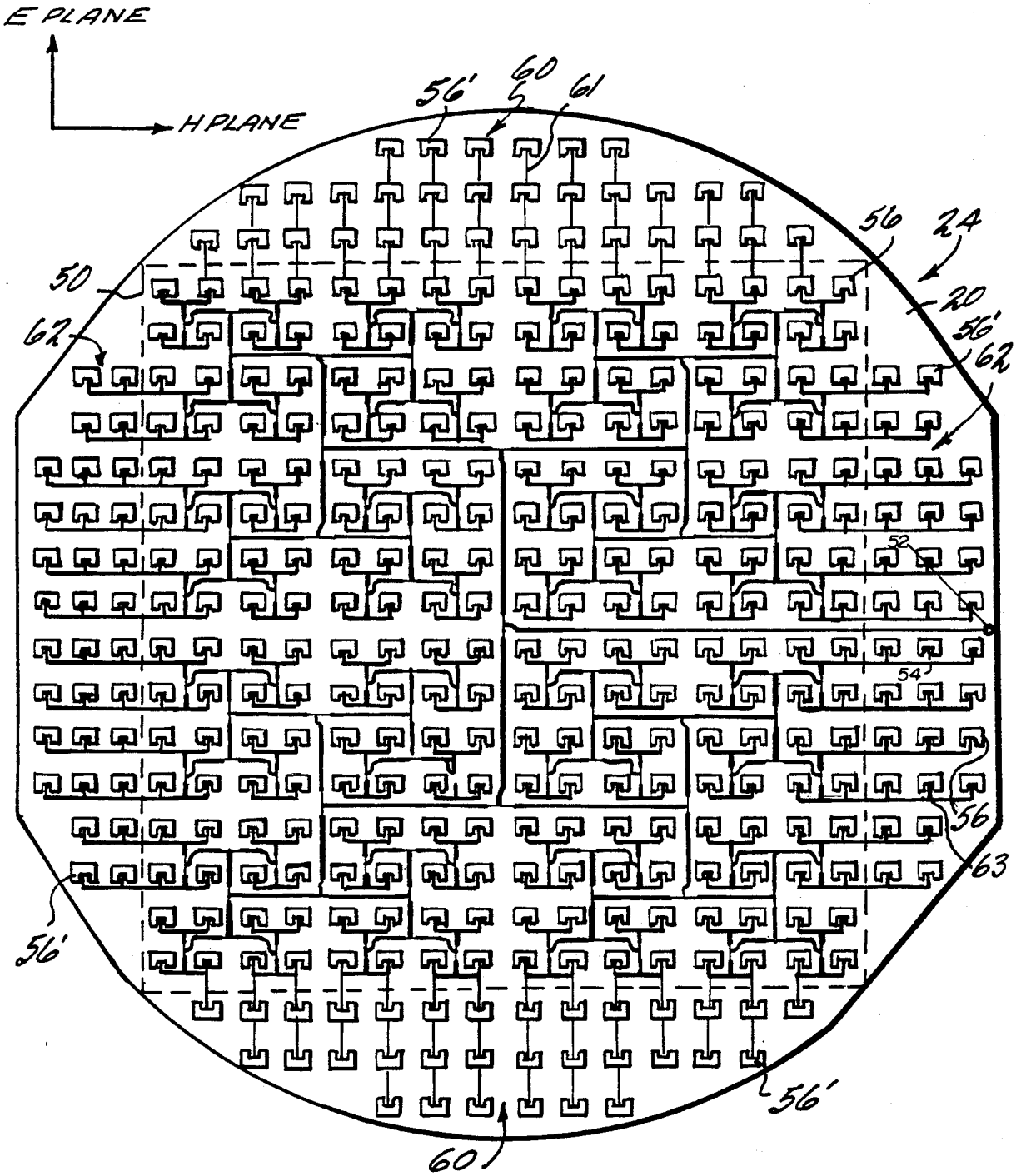
Figure 4:
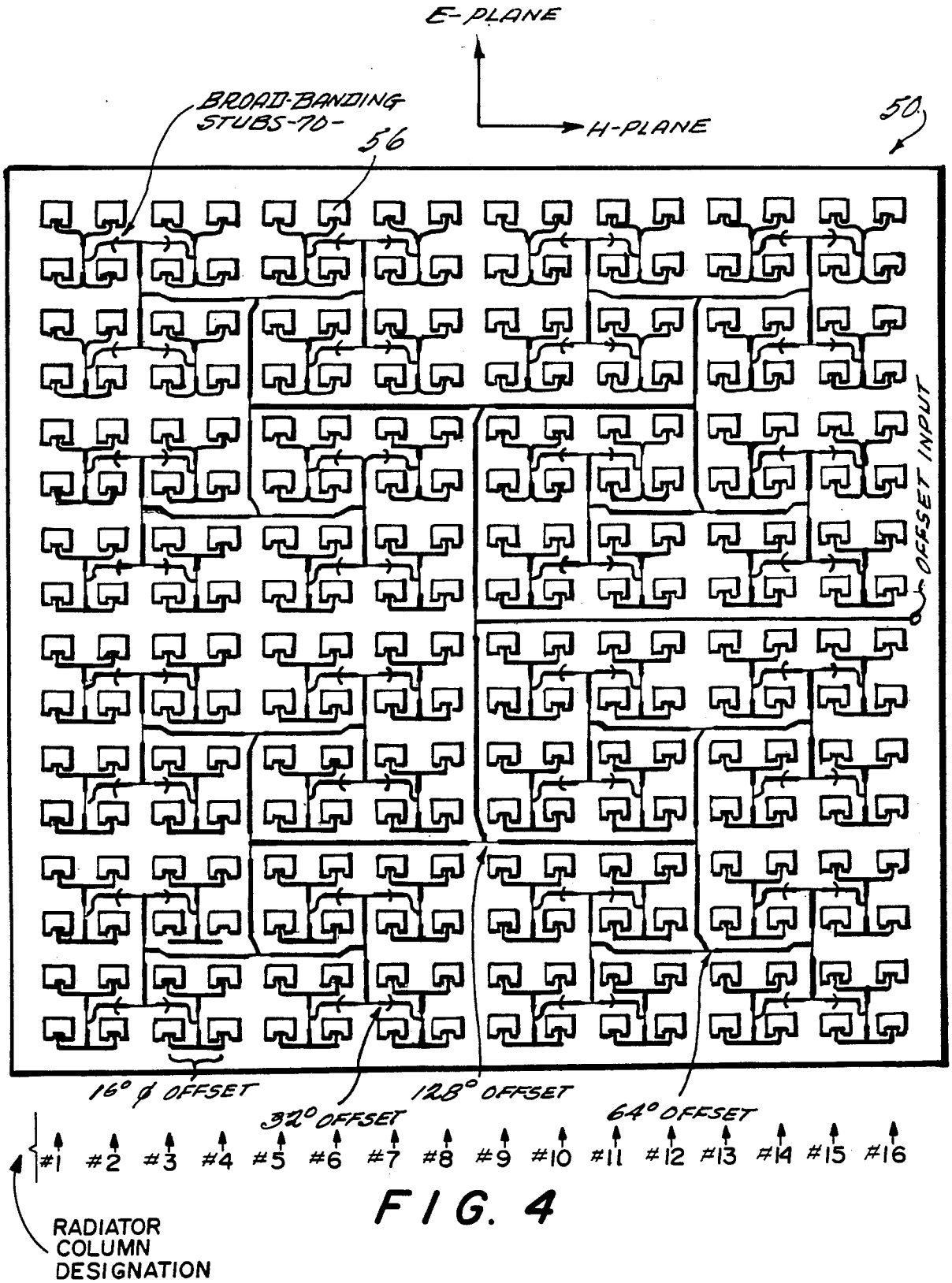
Figure 5:
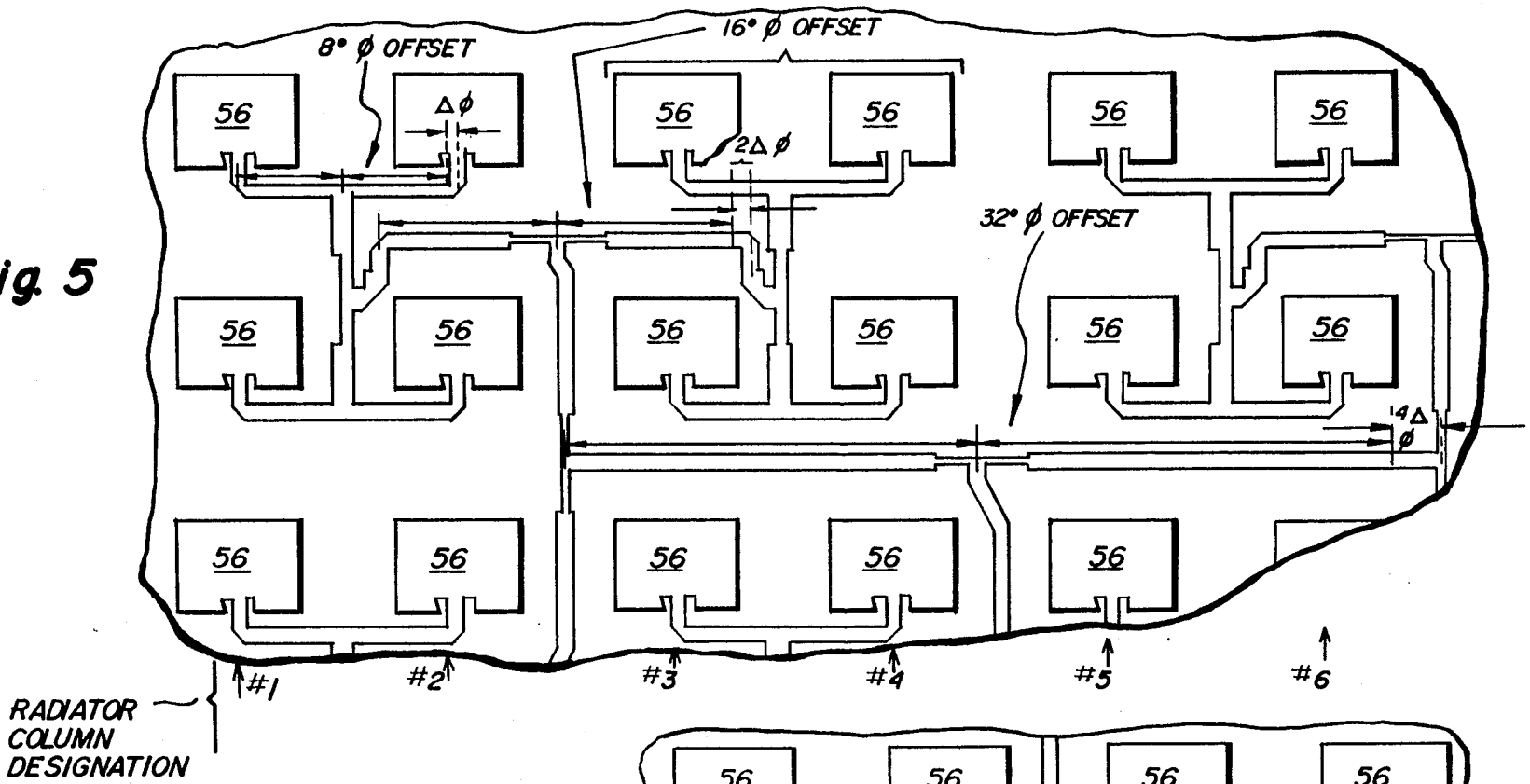
Figure 6:
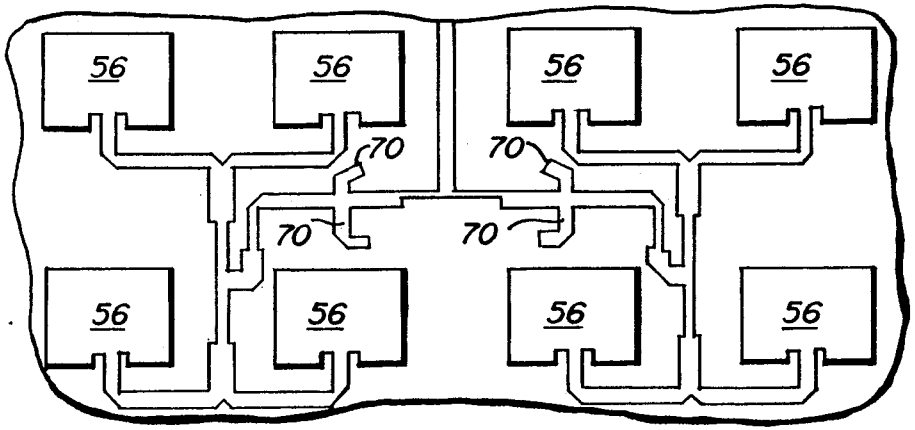

FIG. 3 is a plan view of the integrally formed dual slot microstrip radiator patches and feedline structure of the preferred embodiment of this invention having a 16×16 central array of dual slot radiator patches with a corporate feedline structure and amplitude tapered auxiliary linear arrays extending on all four sides thereof so as to make a substantially circularly shaped overall composite array having the desired characteristics;

FIG. 4 is a plan view similar to FIG. 3 except that only a central 16×16 array is depicted and the fixed angle phase offset in the H-plane and is explicitly denoted optional broad banding dual stubs are also depicted in association with each subset of four dual slot radiator patches within the central array; and FIGS. 5 and 6 are greatly enlarged portions of the structure contained in FIGS. 3 and 4.

Figure 1:
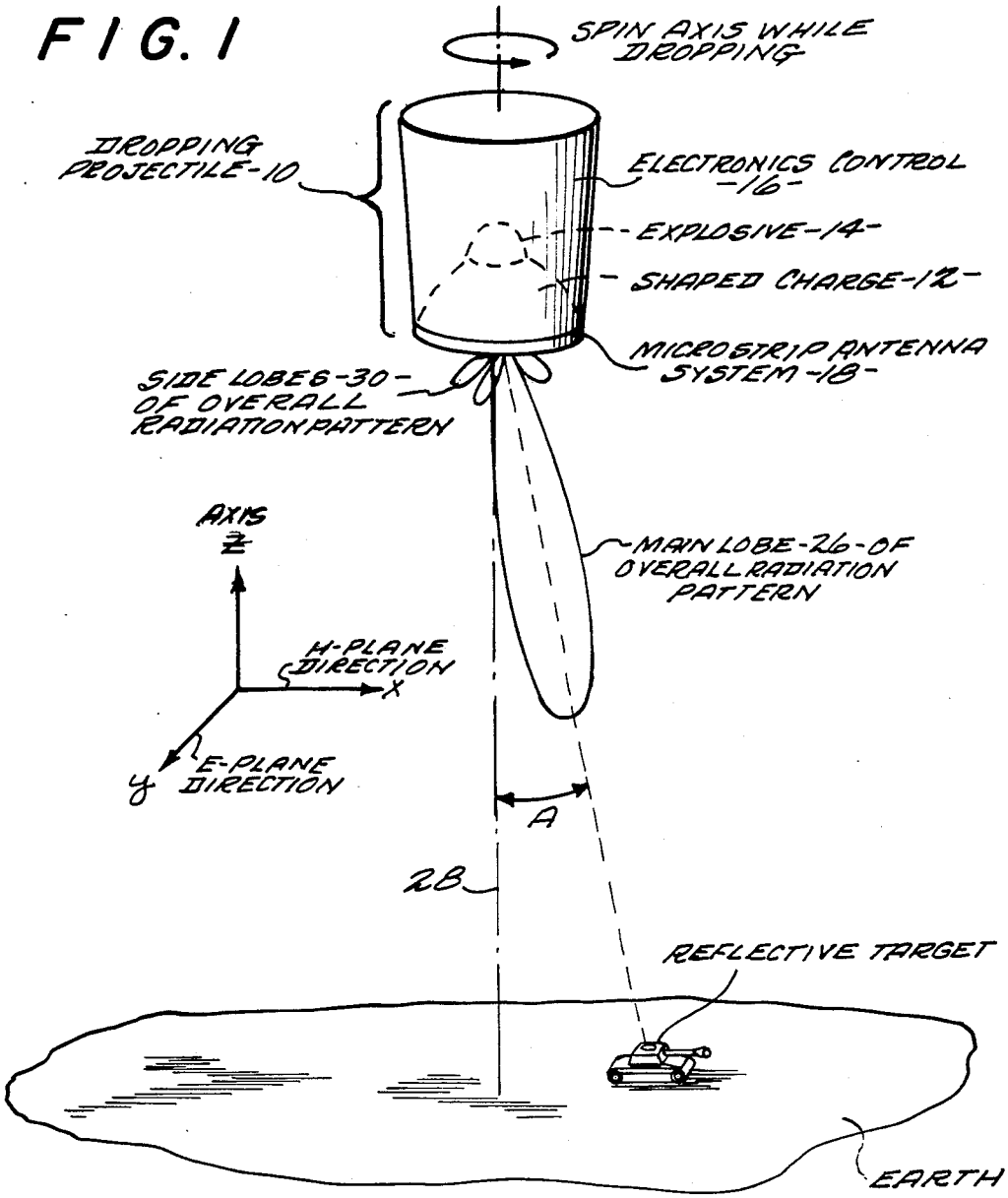
FIG. 1 is a schematic depiction of an overall rotating "smart" projectile having a radar system and a fixed beam steered microstrip antenna in accordance with this invention conformed to the leading surface of the projectile.
Figure 2:
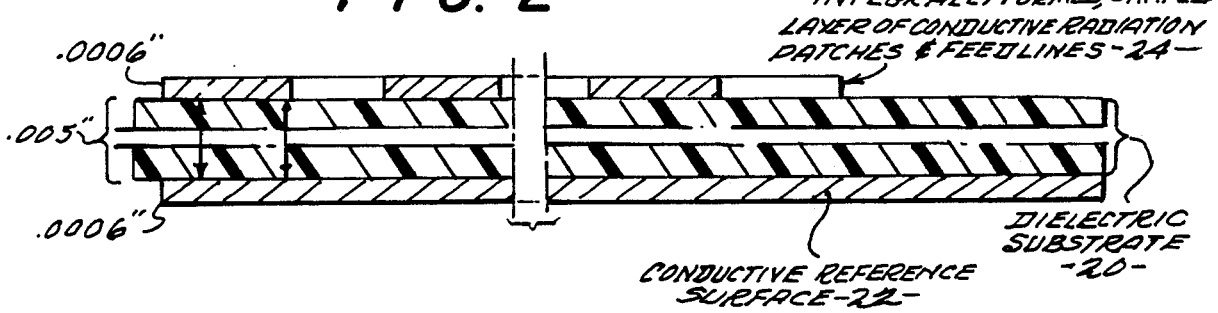
FIG. 2 is a schematic depiction of a cross-section of the laminated microstrip antenna structure shown in FIG. 1.

A dropping projectile 10 is depicted at FIG. 1. It may, for example, include a shaped explosive charge 12 and a detonating explosive 14 in front of suitable radar electronics and steering control mechanisms 16 of suitable design. The r.f. radar portion of the electronics and control module 16 is conventionally coupled (i.e. by coaxial cable or other r.f. transmission line) to a radar sensor or microstrip antenna 18 disposed at the leading surface of the projectile 10 in front of the shaped charge 12. The antenna or sensor element 18 is preferably very, very thin so as to not unduly "defocus" the shaped charge 12 upon its detonation whereupon it will project itself through and destruct the microstrip antenna 18. In the exemplary embodiment, the microstrip antenna 18 comprises an approximately 0.005 inch thick Teflon/-fiberglass dielectric substrate 20 (see FIG. 2) laminated to a conductive reference surface 22 on one side (e.g. 0.0006 inch copper) and an integrally formed shaped layer of conductive radiator patches and feedlines 24 (e.g. also 0.0006 inch copper) on its opposite side. The outermost surfaces of the conductive layers 22, 24 may include a few Angstroms of plated tin weatherproofing if desired. Other camouflaging/weatherproofing layers may also be added if desired so long as they do not unduly interefere with the shaped explosive charge 12. It should be understood that the cross-sectional depiction in FIG. 2 is schematic and intended only to generally depict the overall laminated structure of the microstrip antenna 18. It is not designed to depict the myriad details of the shaped layer 24 as those are depicted in more detail at FIGS. 3 and/or 4.

As will be appreciated by those in the art, the shaped integrally formed layer 24 may be formed by conventional photochemical etching techniques like those used in the production of printed circuit boards. In this manner, the entire intricate composite array of radiator patches and interconnecting feedline structures are integrally formed in one set of common operations.

As depicted in FIG. 1, the microstrip antenna system 18 has a main lobe 26 of its overall radiation pattern which is offset by a predetermined angle A from the spin axis 28 of the projectile 10. In this manner, the main lobe 26 is caused to scan over an area of the earth for reflective targets while the projectile is dropping and spinning. Undesirable side lobes 30 of the overall radiation pattern are preferably minimized as discussed above.

The preferred embodiment of integrally formed shaped conductive radiator patches and feedlines 24 disposed above the dielectric substrate 20 is depicted at FIG. 3. Here, a central substantially square array of 16×16 dual slot microstrip radiator patch elements is shown within the dotted lines 50. The central array is fed from a common r.f. signal input/output point 52 offset to one side of the overall composite array as shown in FIG. 3. It is connected by a "pigtail" microstrip feedline 54 to a traditional corporate-structured microstrip feedline array interconnecting the 16×16 dual slot microstrip radiator elements 56 of the central array shown within dotted lines 50.

In such a conventional corporate-structured feedline, the power of the r.f. signal is split at each juncture. Conventional impedance matching techniques are utilized at each juncture and at each connection point with an individual dual slot radiator patch 56. For example, as depicted in FIG. 3, (and in enlarged form at FIG. 5) each patch 56 has a slight indentation so as to, in effect, permit the feedline to connect to an interior matched impedance point on the radiator patch 56.

In a typical conventional corporate feedline of such a two-dimensional dual slot microstrip radiator array, there is an equal transmission line path length from the common feedpoint 52 to each of the individual dual slot radiator patches 56. Under such circumstances, all of the patches are fed in a common phase and, for a square array of the type shown in FIG. 3, such common phasing would be expected to result in a narrow pencil beam main lobe of the radiation pattern having a main lobe axis substantially centered (i.e. the axis would be along a normal line drawn out of the plane of FIG. 3 passing through the center of the square array). However, as indicated more explicitly at FIG. 4, there are fixed-angle phasing offsets incorporated within the corporate-structured microstrip feedline of the central array 50 so as to cause the main lobe 26 of the overall radiation pattern to be off-centered by the angle A. In the preferred embodiment, such fixed-angle phasing offset is effected only along the H-plane direction. For example, as depicted in FIG. 4 (and in enlarged form at FIG. 5), the third and fourth E-plane column (vertical columns as shown in FIG. 4) of patches 56 are fed by transmission lines having an added length increment corresponding to a 16° phase offset. As also depicted, there is an extra 32° phase offset along the H-plane direction between the sixth and seventh E-plane column of patches 56 within the central array 50. There is also a 128° phase offset along the H-plane direction between the eighth and nineth E-plane column of patches 56 within the central array 50. And there is a 64° phase offset along the H-plane direction between the twelveth and thirteenth E-plane column of patches within the central array 50.

The dimension of each radiator patch 56 in the E-plane direction is a resonant substantially one-half wavelength dimension in the dielectric at the intended antenna operating frequency (e.g. about 35 gigahertz). This defines dual radiation slots between the transverse H-plane direction edges of each patch and the underlying conductive reference surface. At a typical operating frequency of about 35 gigahertz, the wavelength in air will be approximately 0.337 inch while the wavelength within the substrate 20 is approximately, 0.227 inch. Accordingly, the 0.005 inch thick dielectric substrate 20 is only a very small fraction (i.e. less than one-tenth the wavelength and perhaps on the order of only about 2% of one wavelength or so).

Auxiliary linear arrays 60 of a "first type" extend outwardly from the top and bottom peripheries of the central array 50 as depicted in FIG. 3 while similar purpose linear arrays 62 of a "second type" extend outwardly from the opposite left and right peripheries of the central array 50 as depicted in FIG. 3. Each linear array includes auxiliary tapered amplitude microstrip feedlines. These auxiliary tapered amplitude feedlines are connected as shown to the corporate-structured feedlines within the central array 50 (so as to ultimately also be connected to the same common input/output feedpoint 52) and are also connected to each of the auxiliary patches 56' in the linear arrays so as to feed r.f. signals to/from each of the auxiliary patches 56'. However, the amplitude of such r.f. signals is necessarily decreased as distance from the central array 50 increases. In this way, the auxiliary feedlines 61 and 63 are amplitude "tapered" to reduce the amplitude of unwanted side lobes and to desirably also decrease the main lobe beamwidth by amplitude tapering in two dimensions across the overall composite array aperture of the entire antenna system.

The auxiliary feedlines 61 are of a "first type" which have individual microstrip feedlines series-connected between opposing edges of respectively corresponding successive auxiliary patches 56' within the linear arrays 60. This type of amplitude taper is discussed more completely in commonly assigned prior U.S. Pat. No. 4,180,817—Sanford. Similarly, the auxiliary feedlines 63 within each linear array 62 of auxiliary patches 56' are of a second type which include a single modified corporate type microstrip feedline 63 having a series of successive microstrip tap-feedlines connected therealong to respectively corresponding successive auxiliary dual slot radiator patches 56'. Since there are losses associated with the microstrip transmission line, the extra incremental lengths of transmission line associated with each successive microstrip radiator in the second type of linear array 62 also causes a form of amplitude taper as explained more completely in commonly assigned prior issued U.S. Pat. No. Re. 29,911—Munson.

As shown in FIG. 4 (and in enlarged form at FIG. 6), a pair of broad banding stubs 70 may be associated with each of predetermined subsets of the microstrip radiator patches 56 so as to substantially increase the frequency bandwidth over which substantially matched impedance feeding conditions will prevail. The technique of using broad banding stubs of this sort is itself well known in the art. Basically, one of the stubs is slightly more than a quarter-wavelength the intended operating frequency while the other stub is slightly less than a quarter-wavelength. In this manner, the real part of the combined stub impedances substantially cancel and the remaining imaginary part of the stub impedance is chosen so as to substantially cancel the imaginary part of the reflected combined patch impedances at a particular location within the microstrip feedline structure. As will be understood in the art, such broad banding stubs might be associated with each individual radiator patch 56 or with any predetermined subset (e.g. 1, 2, 4, 8, etc.) However, I have determined that the use of a pair of such broad banding stubs with each subset of four microstrip radiator patches 56 (as depicted in FIG. 4) is optimum for the preferred exemplary embodiment depicted otherwise at FIG. 3. Such broad banding stubs may be required so as to permit acceptable manufacturing tolerances while still achieving the other desired antenna system objectives for large scale production quantities.

Although only a few presently preferred exemplary embodiments of this invention has been described in detail, those skilled in the art will understand that there are many possible variations and modifications which may be made to the exemplary embodiments without substantially departing from the novel advantages and benefits of this invention. Accordingly, all such variations and modifications are intended to be included within the scope of the appended claims.

What is claimed is:

1. A microstrip antenna system comprising:

an electrically conductive reference surface;

a sheet of dielectric substrate disposed over said reference surface, said dielectric substrate having a thickness of less than one-tenth wavelength at the intended antenna opeating frequency;

a composite two-dimensional array of integrally formed conductive microstrip radiator patches and feedlines disposed over and supported by said dielectric substrate, said composite two-dimensional array including:

(a) a central two-dimensional array of at least 64 dual slot radiator patches having a resonant E-plane direction dimension of substantially one-half wavelength (in the dielectric) at the intended antenna operating frequency, each such patch thereby defining dual radiations slots between the transverse H-plane direction edges of the patch and the underlying conductive reference surface;

(b) a common r.f. signal input/output connection point offset to one side of said central array;

(c) a corporate-structured array of interconnected microstrip feedlines connecting said input/output connection point to each of said patches and incorporating a fixed-angle phasing offset within the corporate feedline structure for the overall central array thereby steering off-center the main beam of the overall radiation pattern of the antenna system; and (d) auxiliary linear arrays of dual slot auxiliary radiator patches extending outwardly from the periphery of said central array with the auxiliary patches having a half-wavelength resonant E-plane dimension aligned with those of the central array and each auxiliary array including an auxiliary tapered amplitude microstrip feedline connected to said corporate-structured array of feedlines and also connected to the auxiliary patches within its respective auxiliary linear array to reduce the r.f. signal amplitude fed to/-from each auxiliary patch as its distance from the central array increases whereby the amplitude of side lobes and the main lobe beamwidth in the overall radiation pattern of the antenna system are both reduced.

2. A microstrip antenna system as in claim 1 wherein said auxiliary feedlines within each of at least some of said auxiliary linear arrays are of a first type which comprise microstrip feedline series-connected between opposing edges of respectively corresponding successive auxiliary patches.

3. A microstrip antenna system as in claim 1 or 2 wherein said auxiliary feedlines within each of at least some of said auxiliary linear arrays are of a second type which comprise a single microstrip feedline having a series of successive microstrip tap-feedlines connected therealong to respectively corresponding successive auxiliary patches.

4. A microstrip antenna system as in claim 3 wherein:

auxiliary linear arrays of said first type extend in said E-plane direction on two opposite sides of said central array, and auxiliary linear arrays of said second type extend in said H-plane direction on two other opposite sides of said central array.

5. A microstrip antenna system as in claim 1 wherein some of said auxiliary linear arrays disposed towards the edges of said central array have fewer numbers of patches therewithin so as to provide an approximately circularly-shaped overall composite antenna system.

6. A microstrip antenna system as in claim 1 wherein said common r.f. signal input/output connection point is offset to one side of the overall composite antenna system including said auxiliary linear arrays.

7. A microstrip antenna system as in claim 1 further comprising:

(e) pairs of broad-banding microstrip stubs disposed along said corporate structured feedline in association with predetermined subsets of the patches in said central array for increasing the frequency bandwidth over which substantially matched impedance is maintained in feeding r.f. signals to/from such patches.

8. A microstrip antenna system having a planar layer of integrally-formed shaped conductive microstrip radiator patches and feedlines supported above an underlying conductive planar reference surface by a dielectric substrate sheet having a thickness less than one-tenth wavelength at the intended antenna operating frequency, said layer of patches and feedlines comprising:

a central substantially square planar array of at least 16×16 conductive microstrip dual-slot radiator patches, each individual dual slot patch having a resonant E-plane direction dimension of substantially one-half wavelength at the intended antenna operating frequency thereby defining a radiating slot between each transverse H-plane direction edge of the patch and the underlying conductive reference surface;

a common r.f. input/output correction point;

a corporate-structured array of microstrip feedlines connecting said input/output connection point to each of said central array patches and incorporating a fixed-angle H-plane phasing offset within the corporate feedline structure for the overall central array so as to steer the main beam of an overall radiation pattern of the antenna system away from a centered normal line to the central array; and auxiliary linear arrays of dual slot auxiliary radiator patches extending outwardly from the periphery of said central array and including auxiliary microstrip feedlines tapering the amplitude of r.f. signals fed to/from the auxiliary radiator patches in each auxiliary array so as to successively reduce the signal amplitudes associated with each of its patches as distance from the central array increases whereby the amplitude of side lobes and the main lobe beamwidth in the overall radiation pattern of the antenna systems are both reduced.

9. A microstrip antenna system as in claim 8 wherein at least some of said auxiliary arrays are of a first type which each comprise series-connected microstrip feedlines disposed between opposing edges of successive auxiliary patches so as to feed tapered amplitude signals to each successive patch.

10. A microstrip antenna system as in claim 9 wherein at least some of said auxiliary arrays are of a second type which each comprise a single auxiliary microstrip feedline connected to the main corporate feedline structure but wherein each such single auxiliary feedline has a series of auxiliary taplines located therealong for feeding a succession of auxiliary patches with tapered amplitude signals.

11. A microstrip antenna system as in claim 10 wherein:

auxiliary arrays of said first type extend in said E-plane direction on two opposite sides of said central array, and auxiliary arrays of said second type extend in said H-plane direction on two other opposite sides of said central array.

12. A microstrip antenna system as in claim 8 wherein at least some of said auxiliary arrays are of a second type which each comprise a single auxiliary microstrip feedline connected to the main corporate feedline structure but wherein each such single auxiliary feedline has a series of auxiliary taplines located therealong for feeding a succession of auxiliary patches with tapered amplitude signals.

13. A microstrip antenna system as in claim 8 wherein said common r.f. input connection point is disposed asymmetrically with respect to said arrays of radiator patches.

14. A microstrip antenna system as in claim 13 wherein said common r.f. input connection point is disposed substantially at or beyond the periphery of the overall composite of said arrays of radiator patches.

15. A microstrip antenna system as in claim 8 wherein said phasing offset comprises:

a substantially 16 degree phase offset along the H-plane direction between the second and fifth E-plane columns of patches in said central array;

a substantially 32 degree phase offset along the H-plane direction between the sixth and seventh E-plane columns of patches in said central array;

a substantially 128 degree phase offset along the H-plane direction between the eighth and ninth E-plane columns of patches in said central array; and a substantially 64 degree phase offset along the H-plane direction between the twelfth and thirteenth E-plane columns of patches in said central array.

16. A microstrip antenna system as in claim 8, 9, 10, 11, 13, 14 or 15 further comprising:

pairs of broad-banding microstrip stubs disposed along said corporate structured feedline in association with each subset of four of the patches in said central array for increasing the frequency bandwidth over which substantially matched impedance is maintained in feeding r.f. signals to/from such patches.

17. A microstrip antenna system comprising:

an electrically conductive reference surface;

a sheet of dielectric substrate disposed over said reference surface, said dielectric substrate having a thickness of less than one-tenth wavelength at the intended antenna operating frequency;

a composite two-dimensional array of integrally formed conductive microstrip dual slot radiator patches and feedlines disposed over and supported by said dielectric substrate, said composite two-dimensional array including:

a central square array of at least 16×16 dual slot microstrip radiator patches;

a common r.f. signal input/output connection point offset to one side of the entire composite array;

a corporate-structure microstrip feedline interconnecting said input/output connection point to each patch in said central array and incorporating a fixed angle phasing offset therewithin;

auxiliary linear arrays of dual slot microstrip radiator patches extending outwardly from all four sides of said central array; and auxiliary tapered-amplitude microstrip feedlines connecting each patch of the auxiliary arrays with said corporate-structure microstrip feedline.

18. A microstrip antenna system comprising:

an electrically conductive reference surface;

a sheet of dielectric substrate disposed over said reference surface, said dielectric substrate having a thickness of less than one-tenth wavelength at the intended antenna operating frequency;

a composite two-dimensional array of integrally formed conductive microstrip radiator patches and feedlines disposed over and supported by said dielectric substrate, said composite array including:

(a) a central two-dimensional array of dual slot radiator patches;

(b) an r.f. signal input/output connection point offset to one side of said central array;

(c) a corporate-structured array of interconnected microstrip feedlines connecting said said input-/output connection point to each of said patches and incorporating a fixed-angle phasing offset within the corporate feedline structure for the overall central array thereby steering off-center the main beam of the overall radiation pattern of the antenna system; and (d) auxiliary linear arrays of dual slot auxiliary radiator patches extending outwardly from the periphery of said central array and each auxiliary array including an auxiliary tapered amplitude microstrip feedline connected to said corporate-structured array of feedlines and also connected to the auxiliary patches within its respective auxiliary linear array to reduce the r.f. signal amplitude fed to/from each auxiliary patch as its distance from the central array increases whereby the amplitude of side lobes and the main lobe beamwidth in the overall radiation pattern of the antenna system are both reduced.

19. A microstrip antenna system as in claim 18 wherein said auxiliary feedlines within each of at least some of said auxiliary linear arrays are of a first type which comprise microstrip feedline series-connected between opposing edges of respectively corresponding successive auxiliary patches.

20. A microstrip antenna system as in claim 18 or 19 wherein said auxiliary feedlines within each of at least some of said auxiliary linear arrays are of a second type which comprise a single microstrip feedline having a series of successive microstrip tap-feedlines connected therealong to respectively corresponding successive auxiliary patches.

21. A microstrip antenna system as in claim 20 wherein:

auxiliary linear arrays of said first type extend on two opposite sides of said two-dimensional array, and auxiliary linear arrays of said second type extend in said H-plane direction on two other opposite sides of said central array.

22. A microstrip antenna system as in claim 18 wherein some of said auxiliary linear arrays disposed towards the edges of said two-dimensional array have fewer numbers of patches therewithin so as to provide an approximately circularly-shaped overall composite antenna system.

23. A microstrip antenna system as in claim 18 wherein said common r.f. signal input/output connection point is offset to one side of the overall composite antenna system including said auxiliary linear arrays.

24. A microstrip antenna system as in claim 18 further comprising:

(e) pairs of broad-banding microstrip stubs disposed along said corporate structured feedline in association with predetermined subsets of the patches in said two-dimensional array for increasing the frequency bandwidth over which substantially matched impedance is maintained in feeding r.f. signals to/from such patches.

25. A microstrip antenna system having a layer of integrally-formed shaped conductive microstrip radiator patches and feedlines supported above an underlying conductive reference surface by a dielectric substrate sheet having a thickness less than one-tenth wavelength at the intended antenna operating frequency, said layer of patches and feedlines comprising:

a central array of conductive microstrip dual-slot radiator patches;

an r.f. input/output connection point;

a corporate-structured array of microstrip feedlines connecting said input/output connection point to each of said central array patches and incorporating a fixed-angle phasing offset within said microstrip feedlines for said central array so as to steer the main beam of an overall radiation pattern of the antenna system away from a centered normal line to the central array; and auxiliary linear arrays of dual slot auxiliary radiator patches extending outwardly from the periphery of said central array and including auxiliary microstrip feedlines tapering the amplitude of r.f. signals fed to/from the auxiliary radiator patches in each auxiliary array so as to successively reduce the signal amplitudes associated with each of its patches as distance from the central array increases whereby the amplitude of side lobes and the main lobe beamwidth in the overall radiation pattern of the antenna systems are both reduced.

26. A microstrip antenna system as in claim 25 wherein at least some of said auxiliary arrays are of a first type which each comprise series-connected microstrip feedlines disposed between opposing edges of successive auxiliary patches so as to feed tapered amplitude signals to each successive patch.

27. A microstrip antenna system as in claim 26 wherein at least some of said auxiliary arrays are of second type which each comprise a single auxiliary microstrip feedline connected to the main corporate feedline structure but wherein each such single auxiliary feedline has a series of auxiliary taplines located therealong for feeding a succession of auxiliary patches with tapered amplitude signals.

28. A microstrip antenna system as in claim 27 wherein:

auxiliary arrays of said first type extend on two opposite sides of said central array, and auxiliary arrays of said second type extend on two other opposite sides of said central array.

29. A microstrip antenna system as in claim 25 wherein at least some of said auxiliary arrays are of a second type which each comprise a single auxiliary microstrip feedline connected to the main corporate feedline structure but wherein each such single auxiliary feedline has a series of auxiliary taplines located therealong for feeding a succession of auxiliary patches with tapered amplitude signals.

30. A microstrip antenna system as in claim 25 wherein said common r.f. input connection point is disposed asymmetrically with respect to said arrays of radiator patches.

31. A microstrip antenna system as in claim 30 wherein said common r.f. input connection point is disposed substantially at or beyond the periphery of the overall composite of said arrays of radiator patches.

32. A microstrip antenna system as in claim 25 wherein said phasing offset comprises:

a substantially 16 degree phase offset between second and fifth columns of patches in said central array;

a substantially 32 degree phase offset between sixth and seventh columns of patches in said central array;

a substantially 128 degree phase offset between eighth and ninth columns of patches in said central array; and a substantially 64 degree phase offset between twelfth and thirteenth columns of patches in said central array.

33. A microstrip antenna system as in claim 25 further comprising:

pairs of broad-banding microstrip stubs disposed along said corporate structured feedline in association with each subset of four of the patches in said central array for increasing the frequency bandwidth over which substantially matched impedance is maintanined in feeding r.f. signals to/from such patches.

34. A microstrip antenna system comprising:

an electrically conductive reference surface;

a sheet of dielectric substrate disposed over said reference surface, said dielectric substrate having a thickness of less than one-tenth wavelength at the intended antenna operating frequency;

a composite two-dimensional array of integrally formed conductive microstrip dual slot radiator patches and feedlines disposed over and supported by said dielectric substrate, said composite array including:

a first array of dual slot microstrip radiator patches;

an r.f. signal input/output connection point;

a corporate-structure microstrip feedline interconnecting said input/output connection point to said first array and incorporating a fixed angle phasing offset therewithin;

auxiliary linear arrays of dual slot microstrip radiator patches extending outwardly from all four sides of said first array; and auxiliary tapered-amplitude microstrip feedlines connecting each patch of the auxiliary arrays with said corporate-structure microstrip feedline.

35. A microstrip antenna system comprising:

an electrically conductive reference surface;

a sheet of dielectric substrate disposed over said reference surface, said dielectric, substrate having a thickness of less than one-tenth wavelength at the intended antenna operating frequency;

a composite two-dimensional array of integrally formed conductive microstrip radiator patches and feedlines disposed over and supported by said dielectric substrate, said composite array including:

(a) a central two-dimensional array of dual slot radiator patches;

(b) an r.f. signal input/output connection point offset to one side of said central array;

(c) a corporate-structured array of interconnected microstrip feedlines connecting said input/output connection point to each of said patches and incorporating a fixed-angle phasing offset within the corporate feedline structure for the overall central array thereby steering off-center the main beam of the overall radiation pattern of the antenna system; and (d) pairs of broad-banding microstrip stubs disposed along said corporate structured feedline in association with predetermined subsets of the patches in said central array for increasing the frequency bandwidth over which substantially matched impedance is maintained in feeding r.f. signals to/from such patches.

* * * * *